US007287531B2

(12) United States Patent
Desmond

(10) Patent No.: US 7,287,531 B2
(45) Date of Patent: Oct. 30, 2007

(54) METHOD OF MAKING A SMOKING PRODUCT

(76) Inventor: Gregory Desmond, Flat 141, Block 3, d.8/6, Novocheryomushinskaya, Moscow, 117036 (RU)

( * ) Notice: Subject to any disclaimer, the term of this patent is extended or adjusted under 35 U.S.C. 154(b) by 143 days.

(21) Appl. No.: 10/249,424

(22) Filed: Apr. 8, 2003

(65) Prior Publication Data

US 2004/0200487 A1 Oct. 14, 2004

(51) Int. Cl.
*A24F 13/02* (2006.01)
*A24F 1/28* (2006.01)

(52) U.S. Cl. ..... 131/187; 131/191

(58) Field of Classification Search ..... 131/187, 131/175, 70, 71, 72, 191
See application file for complete search history.

(56) References Cited

U.S. PATENT DOCUMENTS

| | | | | | |
|---|---|---|---|---|---|
| 47,080 | A | * | 4/1865 | Arnold | 131/361 |
| 3,065,756 | A | * | 11/1962 | Davies | 131/181 |
| 3,498,299 | A | | 3/1970 | White | |
| 3,524,450 | A | | 8/1970 | Molina et al. | |
| 5,167,241 | A | * | 12/1992 | Ruppert et al. | 131/70 |

* cited by examiner

*Primary Examiner*—Steven P. Griffin
*Assistant Examiner*—Michael J. Felton
(74) *Attorney, Agent, or Firm*—Cesari and McKenna, LLP

(57) ABSTRACT

A method of making a smoking product of a cigarette type which can be quickly and personally made in one minute and can be filled with any amount and type of tobacco according to the smoker's will.

5 Claims, 1 Drawing Sheet

METHOD OF MAKING A SMOKING PRODUCT

FIELD OF THE INVENTION

The present device derives from the tobacco industry and is an auxiliary smoking product with cigarette holder, representing a product combining the consumer characteristics and quality of cigarettes.

BACKGROUND OF THE INVENTION

Different types of cigarettes are known in the world. Common for all is the tobacco core inserted in cigarette paper jacket and a short cut cigarette holder made from pressed paper, for example. It should be noted that the cigarette holder and the tobacco core are put together in a single whole by a paper band (U.S. Pat. No. 3,498,299 cl. A24D 1/04; pat. GB No 2,203,324, cl. A24D 1/04).

Tobacco products described in U.S. Pat. No. 3,524,450 are the closest in the technical sense and purpose to the proposed utility model. These products have an elongated cigarette holder of cardboard-type pressed fibrous material and a cylindrical tube for tobacco content. The tobacco core tube and cigarette holder are united together with the help of a paper fillet.

In the well-known cigarettes, the tobacco core tube has a permanent non-changeable length and therefore a certain given amount of tobacco in the cigarette. Therefore, if a smoker wants to decrease the amount of smoked tobacco he will have to put out the cigarette, and either store somewhere or throw out the non-smoked part, which makes it inconvenient, non-economic and violates the ecology of smoking.

The purpose of the invention is to create such a cigarette smoking product that will enable one to change the amount of smoked tobacco according to the smoker's intent or habit.

Another purpose of the invention is to create a smoking product that is easy to produce personally.

A further purpose of the invention is to create a smoking product that combines the features and quality of filter and non-filter cigarettes.

The aforementioned are goals achieved by the present smoking product. It contains a cigarette holder made from pressed cardboard-type fibrous material that, in essence, is a coreless tubular element with a long axis, and a tobacco core tube also of cylindrical form manufactured from parchment. The novelty is that the tobacco core tube has a slightly larger diameter and length than the diameter and length of the above-mentioned cigarette holder and this core tube partially envelops the outside of the cigarette holder in order to form a core to be filled by tobacco. The tobacco core tube is made in a way enabling it to move along the long axis of the cigarette holder in order to change the volume of space for tobacco.

Figure 1:
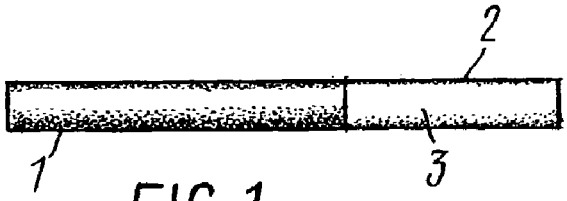

The utility model shall be hereby described in detail in the description with reference to the attached drawings, in which:

FIG. 1 depicts an embodiment of the proposed smoking product of cigarette type; and FIGS. 2*a*-2*e* depict the procedure for making the FIG. 1 smoking cigarette-type product.

The proposed cigarette-type product includes a cigarette holder 1 (FIG. 1), made from pressed fibrous material of cardboard type that constitutes a coreless tubular element, 5 cm long with a long axis, and a tobacco core tube 2 of cylindrical form of parchment. Core tube 2 has a slightly larger diameter and length than that of the above-mentioned cigarette holder 1, i.e., the length of the illustrated core tube amounts to 8 cm. Core tube 2 envelopes partially from the outside the cigarette holder 1 and thus a space 3 is formed for tobacco filling 4 (FIG. 2*c*). Core tube 2 has the possibility to move along the long axis of the cigarette holder 1, thus enabling a change in the volume of space 3 for the tobacco. The sliding of the core tube is made by hand to the extent needed.

The Cigarette holder is made as follows.

Figure 2A:
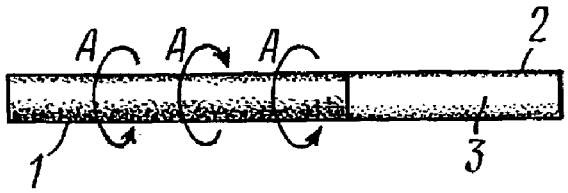
Figure 2B:
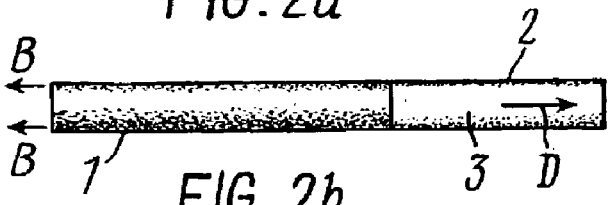
Figure 2C:
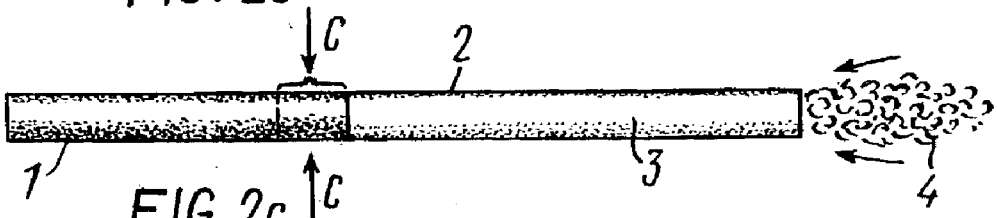

At first the sample (cigarette-paper) should be twisted clockwise and counterclockwise pursuant to indicator "A", as shown in FIG. 2*a*, in order to rumple, soften and separate the cardboard layer from the parchment layer, i.e. to release the tobacco core tube 2. Then with two fingers of one hand one should take the cigarette holder 1 at its base, as it is indicated in FIG. 2*c* with arrow "B" and easily, without effort pull out the cigarette holder in the direction as indicated with arrow "D", i.e. to the right almost to the end leaving a small part "C" 1 cm long, overlapping tobacco core 2. Further, two fingers should press the indicated part "C", that is made of a cardboard layer and a parchment layer so that the tobacco does not fall into the space in the cigarette holder 1. Then one should fill space 3 with loose tobacco 4 (FIG. 2*c*) by hand.

Figure 2D:
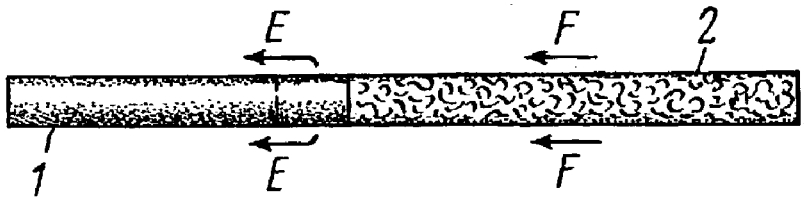
Figure 2E:
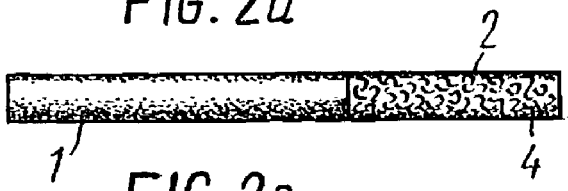

After space 3 is filled in sufficiently, with the help of two fingers one should pull at the base of tobacco core tube 2, on FIG. 2*d* this place is indicated with arrow "E", down towards the base of the cigarette holder 1, as indicated on FIG. 2*d* with arrows "F". Tobacco 4 automatically under pressure from all the sides of core 2 will be press-filled in that the part of the space that was pressed up and that connects the cigarette holder 1 with the core tube 2, will not allow the tobacco to penetrate inside the cigarette holder 1. Thus, the hand-made cigarette (FIG. 2*e*) filled with tobacco 4 is ready to use, i.e. tobacco core tube 2 with tobacco 4 is ready for being lit and smoked with the lower part the cigarette holder 1 acting as a sort of filter.

The procedure of manufacturing this cigarette takes no more than one minute. And since core tube 2 can be moved along the long axis of the cigarette holder 1, the amount of tobacco in space 3 can be increased, or decreased, i.e. this method enables a cigarette to be made of any size with one's own hand and with any type of tobacco according to the smoker's desire.

The invention claimed is:

1. A method of making a smoking product comprising the steps of forming an elongated tubular holder having an outer end and an inner end;

forming an elongated tobacco holding tube having an outer end and an inner end;

releasably engaging the tube on the holder so that the tube slidably surrounds the holder;

slidably extending the tube on the holder so that a segment of the tube between the outer end of the tube and the inner end of the holder has a selected first volume;

providing an obstruction in the holder at or adjacent to the inner end thereof;

filling the first volume with tobacco via said outer end of the tube, and retracting said tube on said holder until said tube segment has a selected second volume less than the first volume so as to press fill the tobacco within the tube segment.

2. A method defined in claim 1 including forming the holder and tube of cardboard and cigarette paper, respectively.

3. The method defined in claim 1 including forming the tube so that it is appreciably longer than the holder.

4. The method defined in claim 1 including pinching the tube at or near the inner end of the holder while performing the filling step.

5. The method defined in claim 1 wherein the obstruction is provided by pinching the tube and holder to form a constriction in the holder.

* * * * *